US005155293A

United States Patent [19]

Barton

[11] Patent Number: 5,155,293

[45] Date of Patent: Oct. 13, 1992

[54] SAFETY BOOSTER FOR EXPLOSIVE SYSTEMS

[75] Inventor: John A. Barton, Houston, Tex.

[73] Assignee: Dresser Industries, Inc., Dallas, Tex.

[21] Appl. No.: 626,809

[22] Filed: Dec. 13, 1990

[51] Int. Cl.[5] ..... F42B 3/08; E21B 7/00

[52] U.S. Cl. ..... 102/312; 102/306; 102/313; 102/275.4; 175/4.6

[58] Field of Search ..... 102/306, 312, 313, 275.4; 175/4.6, 4.51, 4.52

[56] References Cited

U.S. PATENT DOCUMENTS

| | | | |
|---|---|---|---|
| 3,174,545 | 3/1965 | Mohaupt | 102/313 X |
| 4,292,895 | 10/1981 | Bell et al. | 102/306 |
| 4,319,526 | 3/1982 | DerMott | 102/310 |
| 4,608,926 | 9/1986 | Stevens | 102/275.4 |
| 4,616,566 | 10/1986 | Yates, Jr. | 102/275.4 X |
| 4,657,089 | 4/1987 | Stout | 175/4.6 |
| 4,738,319 | 4/1988 | McClure et al. | 175/4.6 |
| 4,747,201 | 5/1988 | Donovan et al. | 175/4.55 X |
| 4,850,438 | 7/1989 | Regalbuto | 175/4.56 |
| 4,901,802 | 2/1990 | George et al. | 102/312 X |
| 5,063,822 | 11/1991 | Lopez de Cardenas | 175/4.6 X |

*Primary Examiner*—Peter A. Nelson

[57] ABSTRACT

A safety booster for a perforation gun assembly which includes a cup having at least one opening and a secondary explosive disposed within the cup. The booster also includes a cover for the opening to contain the secondary explosive inside the cup.

7 Claims, 1 Drawing Sheet

SAFETY BOOSTER FOR EXPLOSIVE SYSTEMS

BACKGROUND OF THE INVENTION

This invention relates to a booster charge explosive for transferring detonation from one explosive system to an adjoining explosive system.

It is highly desirable in the oil and gas industry to perforate or make a number of holes in a well bore casing and in the adjacent hydrocarbon bearing geological formation. A common method is to lower into a well bore, a wireline or a tubing perforation gun assembly that includes a large number of shaped explosive charges maintained in certain positions perpendicular to the axis of the well bore. If the hydrocarbon bearing formations are longer than a typical perforation gun assembly, then it is necessary to join or "tandem" additional guns together in order to perforate the entire production geological formation.

In the use of more than one perforation gun assembly, it is necessary to join the guns together so that means are provided to initiate detonation of the successive gun. Generally throughout the industry the detonation means includes a pair of boosters. The first booster located at the bottom of the first perforation gun, is called a "donor" because it passes detonation onto the next successive gun. The second booster located at the top of the next gun is called the "acceptor" because it receives the detonation from the "donor" and initiates the discharge of the shaped charges of the next perforation gun.

Currently, the law prohibits the transportation or storage of charged well perforation guns with boosters attached, because of the potential safety hazard of an accidental detonation. As a result of this law, the guns must be assembled and armed for use in the uncontrolled environment of the site. The attaching of the boosters in this environment greatly increases the safety risks at the site and incidence of gun failures in the well bore.

This problem has been addressed specifically by Regalbuto, U.S. Pat. No. 4,850,438. The Regalbuto patent discloses a modular perforation gun that employs only secondary explosives for the shaped charges, the detonating cord and the acceptor and donor boosters. The use of secondary explosives minimizes the chance of accidental initiation by fire, electrical or frictional spark, or impact. Generally, if set afire these explosives would most often burn out nonviolently. But the booster pellet at the top of the cord and the charge at the cord bottom are both covered by cover plates to provide a dustproof, water-resistant chamber. This sealing of the secondary explosives makes the booster more volatile, and therefore capable of detonating to their full potential and thereby accidentally discharging the shaped charges of the perforation gun.

An alternative solution to this problem is an explosive safe arming apparatus for perforation guns shown by DerMott, U.S. Pat. No. 4,319,526. The DerMott patent disclosed a system for wireline perforation guns having an enclosed carrier with an access port therein, an explosive means in the carrier, which includes at least one shaped explosive charge, a receptor detonating explosive cooperatively arranged and adapted for detonating the shaped explosive charge, and a donor detonating explosive adapted for detonating the receptor explosive. The donor detonating explosive included two encased elements, the first element being fixedly secured within the carrier, and the second element being removably mounted within the carrier and adapted to be inserted into the carrier through the access port into an operative relationship with the first element and the receptor detonating explosive. This second element must be disposed through the access port of the carrier into a retention means to arm the perforation gun and the explosive safe arming system. The DerMott patent provided a means for safer arming of perforation guns, but still requires that the arming of the perforation gun be made under possibly severe environmental conditions, which could contribute to a malfunction or an unsafe or improper operation.

SUMMARY OF THE INVENTION

In accordance with the present invention, the drawbacks of the prior art are addressed by safety boosters including a cup having at least one hole and a secondary explosive packed inside the cup.

The invention is adapted for use with explosive systems, and more particularly for well perforation guns. In accordance with a preferred embodiment of the present invention, a hole is located in the bottom of the cup to provide a vent relief for the accidental ignition of the secondary explosive and a more reliable transfer of detonation between successive perforation guns.

Accordingly, it is an object of this invention to provide a booster that is sensitive for reliable detonation but safe from accidental fire, electrical or frictional spark, or impact.

It is a further object to provide a complete well perforation gun assembly that is transportable and requires no assembly at the jobsite.

It is a feature of this invention to have a booster with a booster cup having at least one hole to allow for more sensitivity to insure proper detonation.

It is an advantage of this invention to have a well perforation gun that is fully assembled and requires no field installation of boosters at the jobsite.

Another important advantage of this invention is that the booster is more sensitive to proper detonation, as well as preventing inadvertent detonation from accidental fire, electrical or frictional spark, or impact.

Another important advantage of this invention is that complete well perforation gun assemblies may be transported without any greater safety risk.

Other objects and features of the invention will be apparent in the following description and claims in which the invention is described, together with details to enable persons skilled in the art to practice the invention, all in connection with the best mode presently contemplated for the invention.

BRIEF DESCRIPTION OF THE DRAWINGS

Drawings accompanying the disclosure, and the various views thereof may be briefly described as.

DETAILED DESCRIPTION OF THE INVENTION

Figure 1:
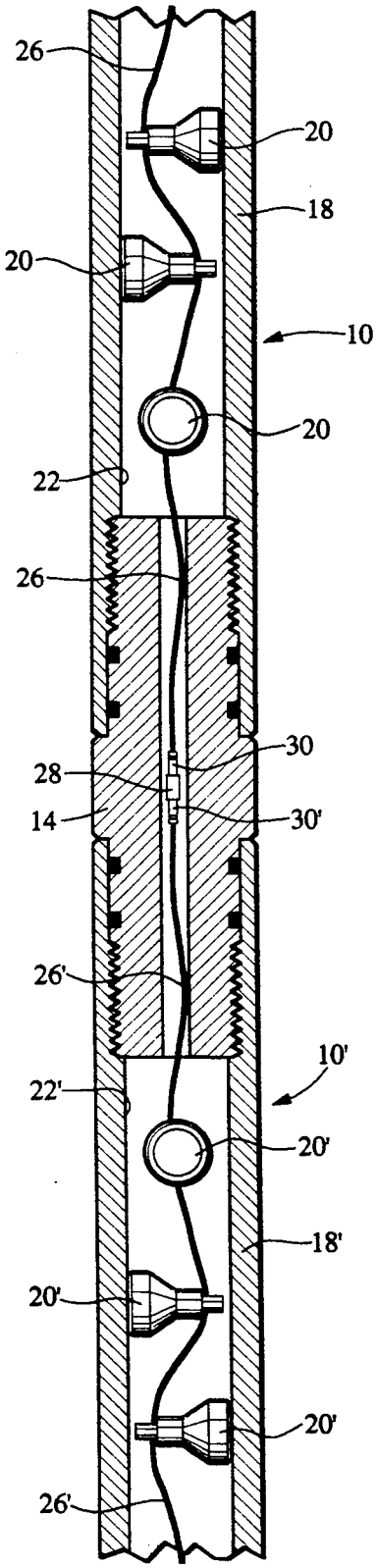
FIG. 1 is a fragmentary lengthwise section of a pair of well perforation guns, each having a booster of the present invention.

The preferred embodiment of the present invention is illustrated by way of example in FIGS. 1–4. With specific reference to FIG. 1, a pair of well perforation gun assemblies 10, 10' are shown joined or "tandemed" together by a coupling 14.

Each perforating gun 10, 10' comprises identical elements, therefore perforating gun 10 will be described in detail and all elements for gun 10' will be denoted with a "'" symbol. Perforating gun 10 includes a cylindrical housing 18, enclosing a plurality of shaped explosive charges 20. Each shaped charge 20 is secured to the interior wall 22 of housing 18. The charges 20 are disposed at various positions to fire out through the housing 18 and into the earth formation.

Figure 2:
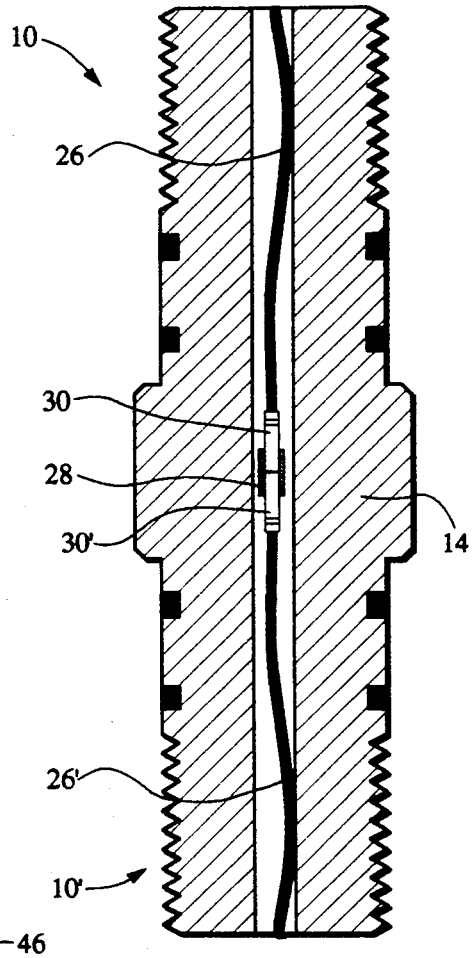
FIG. 2 is an enlarged detailed view of a coupling for the perforation guns of FIG. 1 embodying this invention.

Each charge 20 is connected to a detonating cord 26 that runs the length of each perforating gun assembly 10, 10'. As shown in FIG. 2, a donor safety booster 30 is connected to the bottom of detonating cord 26 of perforating gun assembly 10 and is received in a connector 28. This donor booster 30 passes the detonation on to an adjacent gun assembly 10'. Coaxially aligned with donor booster 30 is acceptor booster 30'. The acceptor booster 30' is connected to the top portion of detonating cord 26' of gun assembly 10' and received into the bottom of connector 28. The acceptor booster 30' receives the detonation from the adjacent donor booster 30 and passes it to the shaped charges 20' of gun assembly 10'. Both donor booster 30 and acceptor booster 30' are identical in structure and therefore donor booster 30 will be described in detail hereafter.

Figure 3:
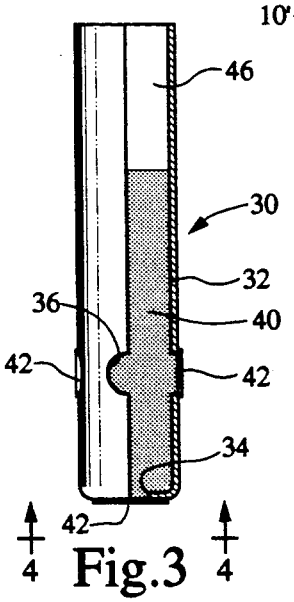
FIG. 3 is a partial cross-sectional view of the booster of the present invention.
Figure 4:
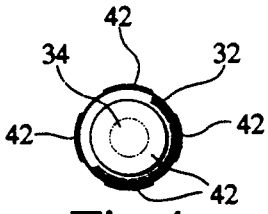
FIG. 4 is an end view taken along lines 4—4 of FIG. 3 of the present invention.

As shown in FIG. 3, donor booster 30 has a cup 32, preferably cylindrical and made of thin wall aluminum or brass. This cup 32 has at least one opening 34 located at the bottom of the cup, as shown in FIG. 4. A plurality of openings 36 may be located about the perimeter of cup 32, as shown in FIG. 3. Preferably, the openings 34 and 36 are from 1/16th to 3/32nds of an inch in diameter.

The booster cup 32 is mostly filled with a secondary explosive 40, such as RDX, HMX, HNS or PYX. To prevent leakage of this secondary explosive 40 through openings 34 and 36, a cover or plug 42 is placed over each of the openings. This cover 42 is made of mylar adhesive that would melt in the event of fire and allow pressure to be relieved from within the booster cup 32. Preferably, the cover 42 is not needed because the secondary explosive 40 is packed together by pressing, so as to adhere the explosive 40 to each other and not leak out through openings 34 and 36. The upper portion 46 of cup 32 receives detonating cord 26 and is crimped around the detonating cord 26.

The application of the safety booster 30, 30' of this invention will now be described with reference to FIG. 1. In the controlled environment of a manufacturing facility, boosters 30 and 30' are crimped to the ends of detonating cords 26, 26'. The ends of boosters 30 and 30' are axially aligned together in close proximity by connector 28 within coupling 14 or guns 10, 10'. When detonation has been initiated to the top of gun assembly 10 by either electrical or mechanical means, the detonation travels through the cord 26 and fires charges 20 through housing 18 and into the geological formation. Detonation travels down and to donor booster 30 igniting the secondary explosive 40, in which booster 30 explodes and passes the detonation through opening 34 and into opening 34' of acceptor booster 30'. This detonation is then passed through cord 26' and down to shaped charges 20' of well perforation gun 10'. The openings 34 and 34' allow the booster to be more sensitive and more likely to fire under explosive attack. The added openings 34, 36 also provide a vent passage through which gases created as a result of accidental fire may escape harmlessly into the gun and ultimately to the atmosphere, thereby allowing the secondary explosive 40 to deflagrate rather than explode and causing detonation of shaped charges 20 or 20'. This invention allows the proper assembly in a controlled environment and the safe transportation of perforation gun assemblies to the jobsites. Accidental fire will not cause the boosters to detonate the cords but instead to harmlessly burn within the gun.

It is to be understood that the terminology as employed in the description and claims incorporated herein is used by way of description and not by way of limitation to facilitate understanding of the structure, function and operation of the combination of elements which constitute the present invention. Moreover, while the foregoing description and drawings illustrate in detail one successful working embodiment of the invention, to those skilled in the art to which the present invention relates, the present disclosure will suggest many modifications in the construction, as well as widely differing embodiments and applications without thereby departing from the spirit and scope of the invention. The present invention, therefore is intended to be limited only by the scope of the appended claims and applicable prior art.

What is claimed is:

1. A perforation gun assembly comprising:

A) a housing having a top end and lower end, each with an access opening;

B) explosive means located within said housing, including at least one shaped explosive charge;

C) a firing means for providing a detonation wave;

D) an acceptor booster for transmitting said detonation wave, disposed at said top end of said housing, wherein said acceptor booster comprises a cup having at least one hole and a secondary explosive disposed inside said acceptor cup;

E) a detonating cord for transmitting said detonation wave from said acceptor booster to said shaped charge, and to said lower end of said housing; and F) a donor booster for transmitting said detonation wave to an adjoined second perforation gun assembly, said donor booster comprising a cup having at least one hole and secondary explosive disposed within said donor cup, such that said donor booster is adjacent an acceptor booster of the second perforation gun assembly to initiate a detonation wave in the second perforation gun assembly.

2. The perforation gun assembly as set forth in claim wherein said acceptor booster cup and said donor booster cup each include a bottom wall in which said hole is located.

3. The perforation gun assembly as set forth in claim 2 said acceptor booster cup and said donor booster cup each have a peripheral wall adjacent said bottom wall, said peripheral wall having a plurality of holes.

4. The perforation gun assembly as set forth in claim 3 wherein said acceptor booster and said donor booster further include a cover for said peripheral and bottom openings to contain said secondary explosive within said cup.

5. The perforation gun assembly as set forth in claim 4 wherein said acceptor booster cup and said donor booster cup are cylindrical in shape.

6. The perforation gun assembly as set forth in claim 5 wherein said acceptor booster cup and said donor booster cup are made of aluminum.

7. The perforation gun assembly as set forth in claim 4 said cover comprises a material having a low melting point, so that said material would dissipate in heat to provide a vent passage for said secondary explosive.

* * * * *